US006616726B2

(12) United States Patent
Chikahata et al.

(10) Patent No.: US 6,616,726 B2
(45) Date of Patent: Sep. 9, 2003

(54) MATERIAL FOR VALVE GUIDES

(75) Inventors: Katsunao Chikahata, Nagareyama (JP); Koichiro Hayashi, Matsudo (JP)

(73) Assignee: Hitachi Powdered Metals Co., Ltd., Matsudo (JP)

( * ) Notice: Subject to any disclaimer, the term of this patent is extended or adjusted under 35 U.S.C. 154(b) by 0 days.

(21) Appl. No.: 09/943,617

(22) Filed: Aug. 30, 2001

(65) Prior Publication Data

US 2002/0023518 A1 Feb. 28, 2002

(30) Foreign Application Priority Data

Aug. 31, 2000 (JP) ..... P2000-262319
Aug. 31, 2000 (JP) ..... P2000-262321

(51) Int. Cl.[7] ..... B22F 3/00
(52) U.S. Cl. ..... 75/246; 75/231; 75/243
(58) Field of Search ..... 75/231, 243, 246

(56) References Cited

U.S. PATENT DOCUMENTS 4,344,795 A 8/1982 Endo et al.
4,648,903 A * 3/1987 Ikenoue et al. ..... 75/230
4,702,771 A * 10/1987 Takagi et al. ..... 75/237
5,259,860 A * 11/1993 Ikenoue et al. ..... 419/11
5,326,526 A * 7/1994 Ikenoue et al. ..... 419/32

FOREIGN PATENT DOCUMENTS

| | | |
|---|---|---|
| EP | 0 481 763 A1 | 4/1992 |
| GB | 2 220 421 A | 1/1990 |
| JP | 51119419 | 10/1976 |
| JP | 57016148 | 1/1982 |
| JP | 2077552 A | 3/1990 |

* cited by examiner

*Primary Examiner*—Ngoclan Mai

(57) ABSTRACT

Disclosed is a sintered alloy material for valve guides, containing: 1.5% to 4% by mass of carbon; 1% to 20% by mass of copper; 0.1% to 2% by mass of tin; 0.01% or more than 0.01% and less than 0.1% by mass of phosphorus; and an iron base. The metallographic structure of the sintered alloy material has a matrix phase composed mainly of pearlite, and a free carbon phase being dispersed in the matrix phase.

9 Claims, 2 Drawing Sheets

MATERIAL FOR VALVE GUIDES

BACKGROUND OF THE INVENTION

1. Field of the Invention

The present invention relates to a sintered alloy material excellent in wear resistance and machinability, in particular, to a sintered alloy material which has distinctly excellent machinability and which is suitable for valve guides of internal combustion engines and manufacture thereof.

2. Related Art

In valve guides of internal combustion engines, special cast iron such as gray cast iron and boron cast iron can be used. However, in the case of cast iron, there are problems with working atmosphere, mass producibility and price, and thus substitution of sintered alloy for it is advancing. A general sintered alloy material is, however, poor in wear resistance, and improvement therefore is necessary. If an alloying component is blended to reinforce the material, the wear resistance of the material reaches a practical level, whereas the machinability thereof is deteriorated in many cases. The valve guide is attached to a cylinder head of the engine and subjected to a finish of the inner hole by reaming, before practical use. Thus, if the valve guide is poor in machinability, the time necessary for reaming may be prolonged and the wear of a reamer may also be advanced to decrease the efficiency of production.

The material for valve guides, which has developed previously by the applicant of the present application in an attempt at attaining both wear resistance and machinability (see Japanese Patent Application Publication (JP-B) No. 55-34858), is a sintered alloy having a composition consisting, by mass, of 1.5 to 4% carbon, 1 to 5% copper, 0.1 to 2% tin and 0.1 to 0.3% phosphorus and the balance iron. This material for valve guides is superior in wear resistance to boron cast iron and is also superior in machinability to conventional sintered materials, though it is harder to machine than cast iron materials. Therefore, it has been used widely by automobile manufacturer. However, owing to the recent change in the circumstances in this field, there is an increasing demand for improvements in qualities and for improvements in productivity as well, and as the material for valve guides, a material further excellent in machinability came to be required accordingly.

SUMMARY OF THE INVENTION

The present invention has been made with the above-described background in mind, and it is, therefore, an object of the present invention to provide a sintered alloy material for valve guides which has both wear resistance and machinability.

In order to achive the above-mentioned object, a sintered alloy material for valve guides, according to the present invention comprises: 1.5% to 4% by mass of carbon; 1% to 20% by mass of copper; 0.1% to 2% by mass of tin; 0.01% or more than 0.01% and less than 0.1% by mass of phosphorus; and an iron base, and having a metallographic structure comprising: a matrix phase comprising pearlite; and a free carbon phase being dispersed in the matrix phase.

BRIEF DESCRIPTION OF THE SEVERAL VIEWS OF THE DRAWINGS

The features and advantages of the sintered alloy material for valve guides according to the present invention will be more clearly understood from the following description of the conjunction with the accompanying drawings in which.

DETAILED DESCRIPTION OF THE INVENTION

Figure 1:
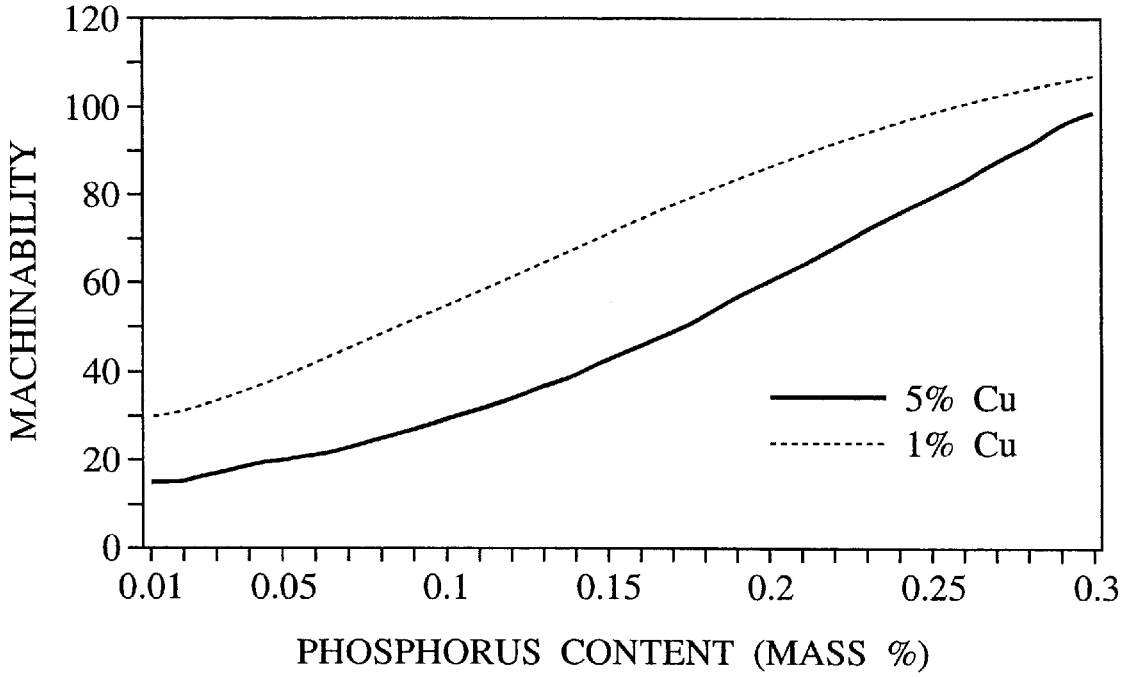
FIG. 1 is a graph showing the relationship between the phosphorus content in the sintered alloy material and the machinability thereof.

On the basis of the conventional material for valve guides, the inventors of the present application have attempted at improvements thereof and arrived at the following results:

(1) when the phosphorus content is reduced, an Fe—P—C ternary alloy phase to be precipitated upon sintering is reduced and simultaneously free graphite is increased to improve machinability; and (2) when the copper content is increased while the phosphorus content is simultaneously decreased, machinability is significantly improved.

The present invention has been achieved on these sights, and the essence of the present invention is that the phosphorus content is restricted in the range of 0.01 to 0.1% by mass ("%" refers hereinafter to % by mass, unless otherwise specified).

Moreover, along with the above restriction on the phosphorus content, a copper content in the range of 6 to 20% by mass or incorporation of enstatite ($MgSiO_3$) and/or manganese sulfide (MnS) in an amount of less than 4% in total is more effective.

In accordance with the above, the material for valve guides according to the first embodiment of the present invention is a sintered alloy having a composition comprising, by mass, of 1.5 to 4% carbon, 1 to 20% copper, 0.1 to 2% tin and 0.01 to 0.1% phosphorus and the balance iron, and the metallographic structure thereof is in a state having free graphite dispersed in the matrix of which the main component is pearlite.

In the case of adding enstatite and manganese sulfide, the composition of the alloy material for valve guides comprises 1.5 to 4% carbon, 1 to 20% copper, 0.1 to 2% tin, 0.01 to 0.1% phosphorus, and less than 4% in total of enstatite and manganese sulfide, the balance being iron, and the metallographic structure thereof is in a state containing free graphite, enstatite and manganese sulfide which are dispersed in a matrix composed mainly of pearlite.

It is recognized that, in the matrix phase of these alloys, an iron-phosphorus-carbon alloy (Fe—P—C) phase is produced according to the content of phosphorus. In the case of a material having a large content of copper or tin, a copper-tin (Cu—Sn) alloy phase is produced, and the copper-tin alloy and/or a copper phase, according to circumstances, are dispersed in the matrix phase mainly composed of pearlite.

Accordingly, the matrix phase mainly composed of pearlite can also be in a state as described above.

In the sintered alloy of the present invention, carbon is added in the form of graphite powder, and a part of the carbon (generally 0.8 to 1%) forms a solid solution with iron to strengthen the matrix, or combines with phosphorus to produce a relatively rigid particulate Fe—P—C alloy phase (steadite phase) dispersed in the matrix phase. The other part of carbon remains in the form of free carbon (graphite) to act as a solid lubricant. The amount of free graphite is about 0.3% in the case of 1.5% whole carbon content, and about 1.7% in the case of 3% whole carbon content. If the amount of free graphite is less than 0.3%, the wear of the valve guide by sliding on a valve is increased. Accordingly, the lower limit of the whole carbon content shall be 1.5%. On the other hand, if carbon is in excess, the surplus carbon causes a reduction in the strength of the matrix. Also upon formation of a compact of powder, it causes segregation and deteriorates fluidity. Thus the upper limit of the carbon content is determined as 4%.

Copper and tin are added usually in the form of a copper-tin alloy powder with a tin content of about 5 to 20%, and it is optionally possible to add a predetermined amount of a copper powder or a tin powder for the supplement. It is of course possible to use only simple powders for these components. Both of these elements advance sintering to form a solid solution reinforcing the matrix, while a part of the material for these elements remains as a copper-tin alloy phase to improve sliding properties and machinability. Such action appears when the copper content is 1% or more and the tin content is 0.1% or more, but if these elements are added in excess, the dimensional accuracy of the product is deteriorated due to gross copper at the time of sintering. In this connection, if a copper phase is dispersed along with the copper-tin alloy phase, said action is further enhanced and the effect becomes significant when the copper content is 6% or more. However, if the copper content exceeds 20%, wear resistance is deteriorated, and thus the suitable range of the copper content is 6 to 20%.

Moreover, tin causes the matrix to be brittle, and thus the tin content is restricted to the range of 0.1 to 2%.

Phosphorus is possibly added in the form of an ironphosphorus alloy powder or a copper-phosphorus alloy powder. According as the content of phosphorus is raised, the steadite phase to be produced is increased. Along with this, the rigidity of the base material is increased and the wear resistance thereof is improved, whereas the machinability thereof is lowered. Accordingly, the content of phosphorus is restricted to less than 0.1% (but 0.01% or more) to increase free graphite and improve machinability. As the amount of phosphorus is decreased, wear resistance is lowered but is still at a significantly higher level than that of gray cast iron. Particularly when the copper content is 5 to 20%, the wear amount of the resulting alloy is ⅓ or less of the loss of gray cast iron.

Enstatite is a magnesium metasilicate mineral in the form of rhombic particles having a cleavage plane. It is similar to free graphite to act as a solid lubricant and simultaneously improves machinability as well. Manganese sulfide also acts similarly but further has the action of improving the wear resistance of the matrix. Both of these compounds are added in the form of powder. Enstatite and manganese sulfide (preferably in an amount of 20 to 30% of the amount of enstatite) can be mixed and used to further improve wear resistance and machinability while maintaining good balance thereof.

These solid lubricants including free graphite are dispersed in the matrix to exhibit the solid lubrication effect, but as the amount of the solid lubricant contained (dispersed) therein is increased, the strength of the material is lowered. If their amount exceeds 4%, it is difficult to maintain the strength of the material necessary as the valve guide material, and thus the total amount of the solid lubricants (free graphite, enstatite and manganese sulfide) is, desirably 4, % or less in the present invention. This means that, for example, if the total amount of carbon is 1.5% and the amount of free graphite is 0.7%, enstatite and manganese sulfide may be contained in a total amount of 3.3% at the maximum.

The valve guide can be manufactured by: preparing a mixed powder by mixing the raw materials for respective components as described above; pressing the mixed powder in a die to form a green compact for the valve guide; and sintering the compact, with use of the conventional methods in powder metallurgy. Here, the sintering atmosphere is preferably a reducing or carburizing atmosphere, and the sintering temperature is preferably 980 to 1100° C. because excessively high temperatures cause free graphite to disappear.

In the manufacture of the sintered alloy material for valve guides, it is off course possible to add a powder lubricant such as zinc stearate or the like to the mixed poweder, for improving compressibility of the mixed powder and stripping easiness of the sintered product from the die. Moreover, it is to be noted that inevitable amounts of metal impurities are allowed in the material for valve guides of present invention.

EXAMPLES

Example 1

First, the following raw materials were prepared: natural graphite powder as a material for carbon, a Cu-10% Sn alloy powder for tin, an Fe-20% P alloy powder for phosphorus, a reduced iron powder for iron, and zinc stearate as a powder lubricant. Then these raw materials were mixed to prepare several kinds of mixed powder each of which contains 2% carbon, 1% copper (and thus 0.11% tin) or 5% copper (and thus 0.55% tin), 0.01 to 0.3% phosphorus in the entire composition and the balance iron, respectively. In addition, zinc stearate is blended at a ratio of 0.75% by mass to the whole amount of the above mixed powder.

Each kind of mixed powder was pressed into a predetermined shape of compacts at a compacting pressure of 490 MPa and sintered at a reducing gas atmosphere at 1000° C. for 60 minutes to prepare a large number of cylindrical samples of 40 mm in length, 12 mm in outer diameter and 7.4 mm in inner diameter. In each kind of sample, the metallographic structure of sintered material had a dense pearlite matrix phase and reddish Cu—Sn alloy particles were dispersed therein. In those samples with a higher content of phosphorus, a large number of particles of whitish Fe—P—C alloy phase (steadite phase) were scattered therein, whereas in those samples with a lower content of phosphorus, such spots were reduced. Moreover, the sample with a higher content of phosphorus (0.3%) and the sample with a lower content of phosphorus (0.03%) were compaired by cutting each sample into powder and dissolving in acid, and subjecting the insoluble residues in the acid to measurement of the amount of free graphite. The results indicated that the amount of free graphite in the latter sample (0.03% P) was higher by about 0.2 to 0.3% than in the former (0.3% P).

Next, each sample thus obtained was examined for machinability and wear resistance. The machinability of each sample was determined by: subjecting the inner hole thereof to reaming; measuring the time required for 10 mm of advance of reaming in the axial direction; and converting the measured time into an index relative to that (=100) of the material comprising 5% Cu and 0.3% phosphorus which corresponded to the conventional material. Accordingly, a smaller index means that the sample can be easily machined to shorten the reaming time, that is, it has good machinability. The wear resistance of each sample was determined by: forming it into a valve guide having a predetermined shape and dimension; attaching the valve guide to a test engine unit; allowing a valve loaded with a radial loading to reciprocate in the valve guide under heat for a predetermined time; and determining the change (wear amount) in the dimension of the inner hole of the sample before and after the test.

Figure 2:
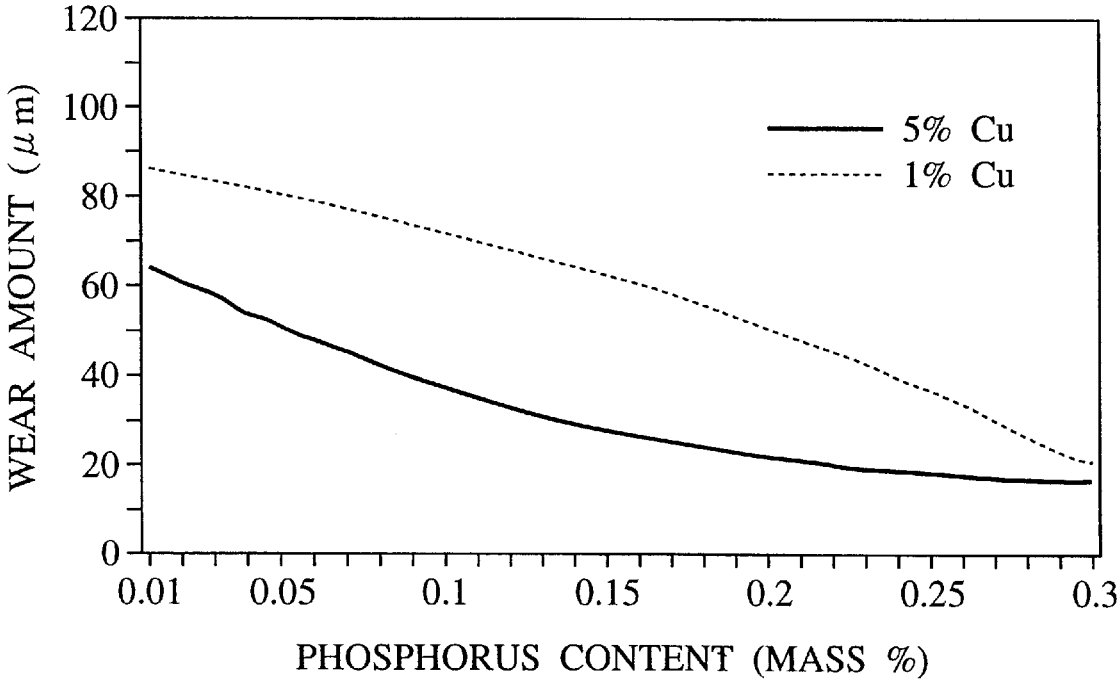
FIG. 2 is a graph showing the relationship between the phosphorus content in the sintered alloy material and the wear amount thereof.

FIGS. 1 and 2 are graphs where the above data were plotted, and FIG. 1 shows the relationship between the content of phosphorus and machinability, and FIG. 2 shows the content of phosphorus and wear resistance. From these graphs, the following can be understood: for the influence of copper, the sample is made superior in both machinability and wear resistance in a higher copper amount in the range of 1 to 5% cupper regardless of the content of phosphorus; and, in respect of the influence of phosphorus, machinability is improved almost linearly as the content of phosphorus is decreased starting from 0.3%, and this tendency continues even below 0.1% phosphorus or below the lower limit in the conventional material. Accordingly, restriction of the phosphorus content to less than 0.1% is of great significance for improving machinability. Further, as a result of restriction of the phosphorus content, although the wear amount is slightly higher than that of the conventional material, the wear amount of 80 $\mu$m, of the sample with 1% copper and 0.05% phosphorus, is still in a practically allowable range nevertheless. And it is also significantly superior to the wear amount of 170 $\mu$m, of a valve guide of gray cast iron under the same test conditions.

Example 2

The raw materials prepared in Example 1 were used to prepare a mixed powder including 2% natural graphite powder, 5% of Cu-10% Sn alloy powder, 0.25% of Fe-20% P alloy powder, 0.8% enstatite powder and 0.2% manganese sulfide powder and the balance being reduced iron powder. The entire composition contained 2% C, 4.5.% Cu, 0.5% Sn, 0.05% P, enstatite and manganese sulfide, and the balance iron. For comparison, a mixed powder having the same composition as above except that enstatite and manganese sulfide powder were not added was prepared. In each of the mixed powders, 0.75% zinc stearate to the amount of the mixed porder was blended additionaly.

Then, these two kinds of mixed powder were subjected to compacting and sintering under the same conditions as in Example 1, and the machinability and wear resistance of the resulting samples were examined. As a result, the data on the former containing enstatite and manganese sulfide are that the machinability index is 23 and the wear amount is 50 $\mu$m. In contrast, the data on the latter are that the machinability index is 25 and the wear amount is 55 $\mu$m. The results indicates that the former is superior to the latter in both machinability and wear resistance. In view of the metallographic structure of both samples, the former has free graphite, enstatite and manganese sulfide dispersed therein as lubricant materials in the matrix phase, whereas the latter has free graphite only dispersed therein, and this difference is considered to be attributable to the difference in their characteristics.

Example 3

First, the following raw materials were prepared: natural graphite powder as carbon; Fe-20% P alloy powder as phosphorus; copper powder; Cu-10% Sn alloy powder as copper and tin; reduced iron powder as iron; and zinc stearate as a powder lubricant. Then, these materials were mixed at a predetermined ratio to prepare several kinds of mixed powder respectively containing: 2% carbon; 0.01%, 0.03%, 0.1% or 0.3% phosphorus, respectively; 2 to 30% copper; 0.1 to 2% tin; and the balance being reduced iron powder. Additionaly, 0.75% zinc stearate to the amount of the mixed powder was added to each of the mxied powder.

Each kind of mixed powder was pressed into a predetermined shape of compacts at a compacting pressure of 490 MPa and sintered at a reducing gas atmosphere at 1000° C. for 60 minutes to prepare a large number of cylindrical samples of 40 mm in length, 12 mm in outer diameter and 7.4 mm in inner diameter. In each kind of sample, the metallographic structure of sintered material had a dense pearlite matrix phase and reddish Cu—Sn alloy particles were disperseed therein. In thosee samples of a high copper content, particles of copper phase were further dispersed therein. In those samples with a higher content of phosphorus, a large number of spots of whitish Fe—P—C alloy phase (steadite phase) were scattered therein, whereas in those samples with a lower content of phosphorus, such spots were reduced. Moreover, the sample with a higher content of phosphorus (0.3%) and the sample with a lower content of phosphorus (0.03%) were compaired by cutting each sample into powder and dissolving in acid, and subjecting the insoluble residues in the acid to measurement of the amount of free graphite. The results indicated that the amount of free graphite in the latter sample (0.03% P) was higher by about 0.2 to 0.3% than in the former (0.3% P).

Next, each sample thus obtained was examined for machinability and wear resistance. The machinability of each sample was determined by: subjecting the inner hole thereof to reaming; measuring the time required for 10 mm of advance of reaming in the axial direction; and converting the measured time into an index relative to that (=100) of the material comprising 5% Cu and 0.3% phosphorus which corresponded to the conventional material. Accordingly, a smaller index means that the sample can be easily machined to shorten the reaming time, that is, it has good machinability. The wear resistance of each sample was determined by: forming it into a valve guide having a predetermined shape and dimension; attaching the valve guide to a test engine unit; allowing a valve loaded with a radial loading to reciprocate in the valve guide under heat for a predetermined time; and determining the change (wear amount) in the dimension of the inner hole of the sample before and after the test.

Figure 3:
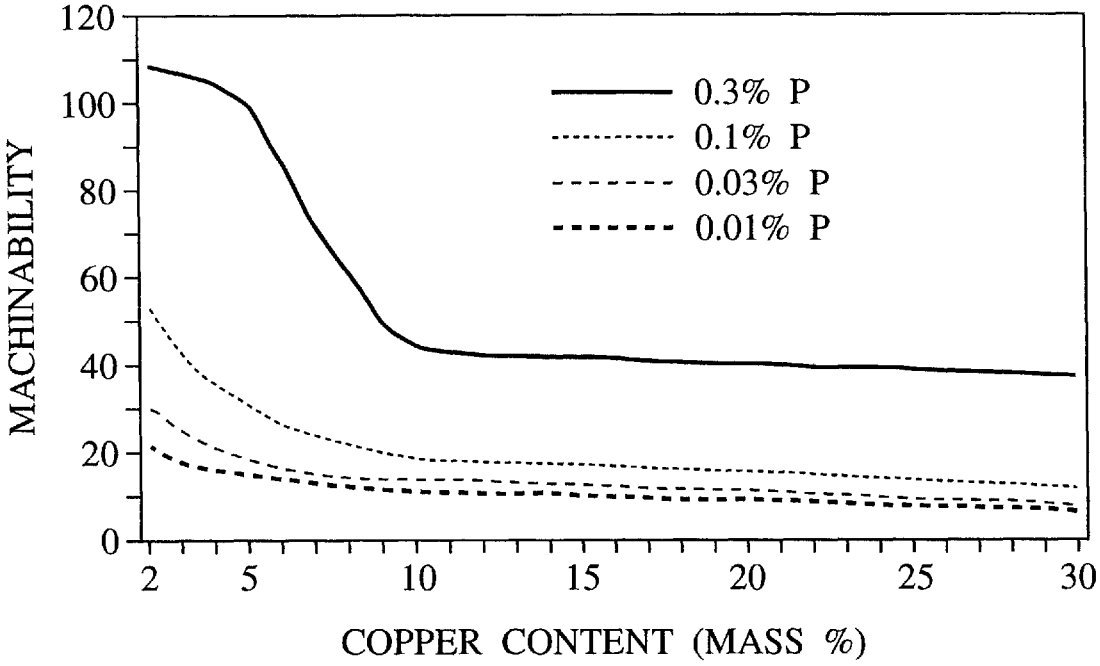
FIG. 3 is a graph showing the relationship between the copper content in the sintered alloy material and the machinability thereof.
Figure 4:
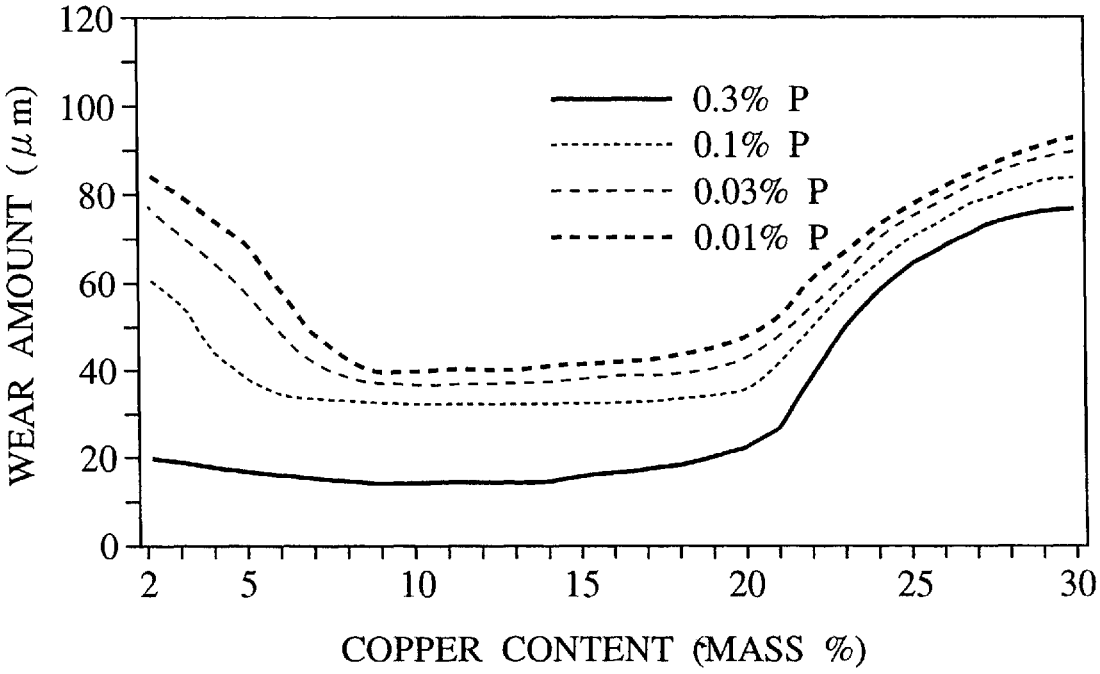
FIG. 4 is a graph showing the relationship between the copper content in the sintered alloy material and the wear amount thereof.

FIGS. 3 and 4 are graphs where the above data were plotted for each content of phosphorus. FIG. 3 shows the relationship between the content of copper and machinability, and FIG. 4 shows the content of content and wear resistance. From these graphs, the following can be understood: in respect of the influence of phosphorus, the sample is superior in machinability in a lower amount of phosphorus and superior in wear resistance in a higher amount of phosphorus in the range of 0.01 to 0.3% phosphorus, regardless of the content of copper; and in respect of the influence of copper, machinability is improved significantly in a copper content of about 5% or more and improved at a slight degree in a copper content of 10% or more until the content of 30%.

On the other hand, the sample exhibits good wear resistance with less wear amount in the range of about 6 to 20% copper, but the wear amount is increased outside of this range. Specifically, the wear resistance is significantly deteriorated in a copper content of 20% or more, regardless of the phosphorus content, while the wear resistance is also significantly deteriorated in a copper content of less than 6% and in a lower content of phosphorus. Even in this range of the present invention, the wear amount is slightly higher as a result of restriction of phosphorus than that of the conventional material, but the wear amount of 56 μm, of the sample with 6% copper and 0.01% phosphorus, is still in a practically allowable range nevertheless. And it is significantly superior to the wear amount of 170 μm of a valve guide of gray cast iron under the same test conditions.

Example 4

The raw materials prepared in Example 3 were used to prepare a mixed powder including 2% natural graphite powder, 5.5% of copper powder, 5% of Cu-10% Sn alloy powder, 0.15% of Fe-20% P alloy powder, 0.8% enstatite powder and 0.2% manganese sulfide powder and the balance being reduced iron powder. The entire composition contains 2% C, 10% Cu, 0.5% Sn, 0.03% P, enstatite and manganese sulfide, and the balance iron. For comparison, a mixed powder having the same composition as above except that enstatite and manganese sulfide powder were not added was prepared. In each of the mixed powders, 0.75% zinc stearate to the amount of the mixed porder was blended additionaly.

Then, these two kinds of mixed powder were subjected to compacting and sintering under the same conditions as in Example 1, and the machinability and wear amount of the resulting samples were examined. As a result, the data on the former containing enstatite and manganese sulfide are that the machinability index is 17 and the wear amount is 35 μm. In contrast, the data on the latter are that the machinability index is 19 and the wear amount is 38 μm. The results indicates that the former is superior to the latter in both machinability and wear resistance. In view of the metallographic structure of both samples, the former has free graphite, enstatite and manganese sulfide dispersed therein as lubricant materials in the matrix phase, whereas the latter has free graphite only dispersed therein, and this difference is considered to be attributable to the difference in their characteristics.

In the present invention, the material for valve guides has machinability, while maintaining wear resistance similar to that of the conventional material as well. Accordingly, usefulness of the present invention is extremely increased, especially when the machinability of the material for valve guides is regarded particularly important from the relationship with the process conditions for manufacture of engines, compatibility with machine tools used, and the like.

This application claims benefit of priority under 35 U.S.C. § 119 to Japanese Patent Application No. 2000-262319, filed on Aug. 31, 2000 and Japanese Patent Application No. 2000-262321, filed on Aug. 31, 2000, the entire contents of which are incorporated by reference herein.

As there are many apparently widely different embodiments of the present invention that may be made without departing from the spirit and scope thereof, it is to be understood that the invention is not limited to the specific embodiments thereof, except as defined in the appended claims.

What is claimed is:

1. A sintered alloy material for valve guides, comprising:

1.5% to 4% by mass of carbon;

1% to 20% by mass of copper;

0.1% to 2% by mass of tin;

0.01% or more than 0.01% and less than 0.1% by mass of phosphorus; and an iron base, and having a metallographic structure comprising:

a matrix phase comprising pearlite;

a free carbon phase being dispersed in the matrix phase;

a copper-tin alloy phase dispersed in the matrix phase; and a steadite phase dispersed in the matrix phase.

2. The sintered alloy material of claim 1, wherein the metallographic structure further comprises:

a copper phase dispersed in the matrix phase.

3. The sintered alloy material of claim 1, wherein the content of the copper in the sintered alloy material is 1% to 5% by mass.

4. The sintered alloy material of claim 1, wherein the contnt of the copper in the sintered alloy material is 6% to 20% by mass.

5. The sintered alloy material of claim 1, further comprising a solid lubricant at a content of 4% by mass or less in the sintered alloy material, wherein the solid lubricant comprises a component which is selected from the group consisting of enstatite and manganese sulfide, and the metallographic structure further comprises:

a phase of the solid lubricant which is dispersed in the matrix phase.

6. The sintered alloy material of claim 5, wherein the total content of the carbon and the solid lubricant is 4% by mass or less in the sintered alloy material.

7. The sintered alloy material of claim 5, wherein the solid lubricant comprises both of enstatite and manganese sulfide, and the ratio of manganese sulfide to enstatite is 20/100 to 30/100 by mass.

8. A sintered alloy material for valve guides, consisting essentially of:

1.5% to 4% by mass of carbon;

1% to 20% by mass of copper;

0.1% to 2% by mass of tin;

0.01% or more than 0.01% and less than 0.1% by mass of phosphorus; and the balance iron, and having a metallographic structure comprising:

a matrix phase comprising pearlite; and a free carbon phase being dispersed in the matrix phase.

9. A sintered alloy material for valve guides, consisting essentially of:

1.5% to 4% by mass of carbon;

1% to 20% by mass of copper;

0.1% to 2% by mass of tin;

0.01% or more than 0.01% and less than 0.1% by mass of phosphorus;

4% or less by mass of a solid lubricant comprising a component which is selected from the group consisting of enstatite and manganese sulfide; and the balance iron, and having a metallographic structure comprising:

a matrix phase comprising pearlite; and a free carbon phase being dispersed in the matrix phase; and a phase of the solid lubricant which is dispersed in the matrix phase.

* * * * *

UNITED STATES PATENT AND TRADEMARK OFFICE

CERTIFICATE OF CORRECTION

PATENT NO. : 6,616,726 B1
DATED : August 12, 2003
INVENTOR(S) : Leif Wilhelmsson et al.

It is certified that error appears in the above-identified patent and that said Letters Patent is hereby corrected as shown below:

Column 7,
Please replace Equation (5) as follows:

$$p_1 = \frac{3P_b(1-P_b)^2}{(1-P_b)^3 + 3P_b(1-P_b)^2}$$

Signed and Sealed this

Sixteenth Day of March, 2004

JON W. DUDAS
*Acting Director of the United States Patent and Trademark Office*